US005345956A

United States Patent [19]

Edmark

[11] Patent Number: 5,345,956

[45] **Date of Patent: * Sep. 13, 1994**

[54] HAIR PIN FOR USE IN CONNECTION WITH A HAIR STYLING TOOL

[76] Inventor: Tomima L. Edmark, 5335 S. Dentwood Dr., Dallas, Tex. 75220

[ * ] Notice: The portion of the term of this patent subsequent to Oct. 12, 2010 has been disclaimed.

[21] Appl. No.: 102,415

[22] Filed: Aug. 4, 1993

Related U.S. Application Data

[63] Continuation of Ser. No. 944,132, Sep. 11, 1992, Pat. No. 5,251,650.

[51] Int. Cl.[5] ..... A45D 8/06

[52] U.S. Cl. ..... 132/280; 132/200; 132/275; 132/281

[58] Field of Search ..... 132/200, 212, 273, 275, 132/280, 281; 63/20

[56] References Cited

U.S. PATENT DOCUMENTS

| | | | |
|---|---|---|---|
| 348,138 | 8/1886 | Overhiser | 132/281 |
| 497,049 | 5/1893 | Granger | 132/281 |
| 595,926 | 12/1897 | Skillen | 132/275 |
| 1,464,187 | 8/1923 | Patten | 132/281 |
| 1,494,280 | 5/1924 | Odom | 132/281 |
| 1,892,262 | 12/1932 | Andrew | 132/273 |
| 2,262,663 | 11/1941 | Botta | 63/20 |
| 2,678,655 | 5/1954 | Butler | 132/281 |
| 3,330,287 | 7/1967 | Muhs | 132/281 |
| 3,441,032 | 4/1969 | Barrett | 132/275 |
| 5,036,870 | 8/1991 | Edmark | 132/273 |
| 5,082,011 | 1/1992 | Wu | 132/273 |

FOREIGN PATENT DOCUMENTS

| | | | |
|---|---|---|---|
| 150785 | 9/1937 | Austria | 132/281 |
| 1242926 | 6/1967 | Fed. Rep. of Germany | 132/281 |
| 5878 | of 1887 | United Kingdom | 132/281 |
| 2068221 | 8/1981 | United Kingdom | 132/273 |

*Primary Examiner*—Gene Mancene
*Assistant Examiner*—Frank A. LaViola
*Attorney, Agent, or Firm*—Baker & Botts

[57] ABSTRACT

A hair pin is provided that maintains its position in the hair for an extended period of time. The hair pin is preferably used in connection with an inverted ponytail hairstyle. The multiple-prong hair pin includes at least one front prong and preferably two rear prongs. At least one prong includes two locking tabs. The elastic band used to create the ponytail is securably engaged between the front and rear prongs and between the upper and lower tabs thereby precluding vertical movement of the hair pin during use.

20 Claims, 1 Drawing Sheet

HAIR PIN FOR USE IN CONNECTION WITH A HAIR STYLING TOOL

CROSS-REFERENCE TO RELATED APPLICATIONS

This is a continuation of application Ser. No. 07/944,132 filed Sep. 11, 1992, by Tomima L. Edmark entitled "Hair Pin For A Hair Styling Tool" now U.S Pat. No. 5,251,650, issued Oct. 12, 1993.

TECHNICAL FIELD OF THE INVENTION

This invention relates generally to a hair pin for securely mounting an ornamental decoration to a hairstyle characterized by an inverted ponytail. More particularly, this invention relates to a multiple prong hair pin with a stop means for positively engaging a hair-binding element, such as a rubber band, to thereby securely mount the hair pin and decorative ornamentation in place on the user's head.

BACKGROUND OF THE INVENTION

The hair styling tool used in connection with the hair pin of the present invention is illustrated in U.S. Pat. No. 5,036,870. The hair styling tool of U.S. Pat. No. 5,036,870 has achieved commercial success because it allows a user to create an attractive hairstyle in a minimum amount of time and it eliminates the need for expensive professional hairstyling. Specifically, the user forms a ponytail and binds the ponytail with a hair-binding element, such as an elastic or rubber band. Then, with a few easy motions and the assistance of the hair styling tool the user can easily invert the ponytail to create an attractive and stable hairstyle. The hairstyle is self-holding and requires little or no hair spray or other hair-holding applications.

The hair styling tool and hairstyle disclosed in U.S. Pat. No. 5,036,870 has become popular because the resulting hairstyle is attractive, fast and easy. People from all walks of life enjoy the hairstyle because it takes little or no time to prepare and the hairstyle maintains its position for an extended period of time. People with straight hair find that the hairstyle provided by the hair styling tool takes less time to prepare on a daily basis than many permed hairdos. Further, many people are finding that the inverted ponytail hairstyle and the hair styling tool obviate the need for permanents which can be very expense. The inverted ponytail hairstyle disclosed in U.S. Pat. No. 5,036,870 has become known as a TOPSYTAIL hairstyle.

One problem not addressed in U.S. Pat. No. 5,036,870 is how to adorn a TOPSYTAIL hairstyle with an ornamental hair pin that will maintain its position for as long as the inverted ponytail hairstyle. Specifically, only hair pins shaped like combs, barrettes or hair pins with a spring biased pin mechanism are provided in the prior art. No hair pin taught by the prior art provides a means for securely affixing the hair pin to the hair binding element, or elastic band, used to create the original ponytail of the hairstyle discussed above. The present invention addresses this problem and provides a hair pin that securely affixes to the elastic band used to create the original ponytail of a TOPSYTAIL hairstyle and thereby provides the user with an opportunity to further adorn this attractive hairstyle with an ornamental hair pin that will stay in place as long as a TOPSYTAIL hairstyle or other hairstyle employing an elastic band or other hair binding element.

SUMMARY OF THE INVENTION

The present invention makes a significant contribution to the art of hair styling by providing a hair pin that securely fastens to the hair binding element used to make a ponytail. Specifically, the present invention provides a hair pin that securely attaches to a hair binding element used to make an inverted ponytail, or a TOPSYTAIL hairstyle.

The hair pin includes at least one front prong and at least one rear prong, with the upper ends of each prong being attached to a platform. The preferred embodiment includes two rear prongs and a single front prong. The platform connects the upper ends of all the prongs and slants upward and backward, toward the user's head, at an angle from about 0° to about 30° from the vertical.

The rear prongs are disposed adjacent to the head of the user and the front prongs are disposed outward from the head. The hair binding element, or elastic band, is accommodated between the front and rear prongs. At least one prong also includes a stop means for lockingly engaging the hair binding element. The preferred stop means for lockingly engaging the hair binding element includes at least two inwardly extending tabs on the front prong. The tabs are separated by a space or a section. The hair binding element is engaged within this section so that the hair hiding element is accommodated between the front and rear prongs and the hair biding element is also engaged between the two tabs on the front prong when the hair pin is in place. This positioning of the hair binding element securely attaches the hair pin to a TOPSYTAIL hairstyle and no adjustments are required to the hair pin for an extended period of time.

Alternatively, the hair binding element may be accommodated between the front and rear prongs and as well as between one tab and the platform, depending upon the hair thickness and desired elevation of the hair pin. Further, a third tab may be added for additional height adjustment. Thus, the hair binding element may be engaged between two tabs or between a tab and the platform as well as the front and rear prongs.

Thus, the hair pin of the present invention and the hair styling tool disclosed in U.S. Pat. No. 5,036,870 provide a system for creating an attractive hairstyle and adorning the hairstyle with a hair pin that maintains its position for an extended period of time. The hair styling tool of the system includes an elongated probe with a lower end for insertion into the ponytail between the hair binding element and the head. The upper end of the probe is attached to a loop. The end of the ponytail is inserted through the loop and then the user pulls on the lower end of the probe thereby pulling the loop and distal end of the ponytail through the ponytail to create an inverted ponytail, or a TOPSYTAIL hairstyle. Preferably, the loop is formed of flexibly resilient material so that it passes through the upper portion of the ponytail easily.

After the ponytail is inverted, or a TOPSYTAIL hairstyle is created, a portion of the hair binding element, or elastic band, is disposed between the user's head and the inverted ponytail. The rear prongs of the hair pin are inserted between this portion of the hair binding element and the user's head. The front prong of the hair pin is inserted between the hair binding element and the inverted ponytail. The hair pin is inserted downward far enough so that the hair binding element is further engaged between two inwardly protruding tabs of the front prong. Thus the hair binding element is accommodated between the front and rear prongs and further engaged between the upper and lower tabs of the front prong.

It will be noted that the stop means for engaging the hair binding element (or two tabs or one tab and the platform) may also be disposed on one or more rear prongs and the invention is not limited to placement of the stop means on one or more front prongs.

The present invention also includes a method of inverting a ponytail and affixing a decorative hair pin to the ponytail. First, the ponytail is created by binding the user's hair with a hair binding element. The lower end of the probe of the hair styling tool is inserted in the ponytail between the user's head and the hair binding element. The distal end of the ponytail is inserted through the loop in a direction toward the user's head. The lower end of the probe is pulled in a downward direction and the loop and ponytail are passed through the portion of the ponytail where the lower end of the probe was inserted. The user pulls the lower end of the probe, or the entire hair styling tool, far enough downward so that the ponytail becomes disengaged from the loop. An inverted ponytail, or TOPSYTAIL hairstyle, has been created.

Then, the hair pin of the present invention is attached to the portion of the hair binding element disposed between the inverted ponytail and the user's head. The rear prongs are inserted between the head and the hair binding element and the front prong is inserted between the hair binding element and the inverted ponytail. The hair pin is pushed downward far enough so that the hair binding element becomes engaged between the two inwardly protruding tabs of the front prong. The hair binding element is disposed between the front and rear prongs and between the upper and lower tabs of the front prong to create a stable configuration for the hair binding element. A decoration or ornamental object is attached to the platform of the hair pin and is clearly visible and facing outward from the back of the user's head.

It is therefore an object of the present invention to provide a multiple prong hair pin for securely attaching to a hair binding element or an elastic band used in hair styling.

It is another object of the present invention to provide an improved system for creating an inverted ponytail and securely attaching a decorative hair pin thereto.

It is still another object to the present invention to provide an improved method for creating an inverted ponytail and adorning the inverted ponytail with a decorative hair pin.

Yet another object of the present invention is to eliminate the need for expensive professional hairstyling services for people whose hair is amenable to inverted ponytail hairstyles.

BRIEF DESCRIPTION OF THE DRAWINGS

This invention is illustrated more or less diagrammatically in the accompanying drawings, wherein.

DETAILED DESCRIPTION OF THE INVENTION

Figure 1:
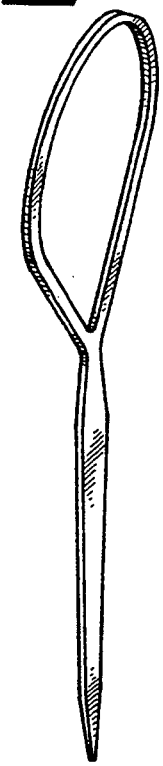
FIG. 1 is a left front perspective view of the hair styling tool made in accordance with the present invention.

Like reference numerals will be used to refer to like or similar parts from Figure to Figure in the following description of the drawings.

Figure 8:
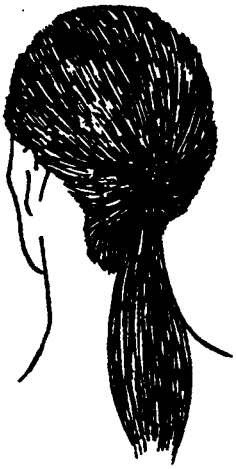

The dramatic improvement contributed by the present invention is best understood after consideration of the hair styling tool 10 shown in FIG. 1 and described in U.S. Pat. No. 5,036,870. The hair styling tool 10 includes a probe 11 with a lower end 12 and an upper end 13. The lower end 12, as will be seen below, is inserted into the hair in the first step in creating the inverted ponytail (see FIG. 6). A loop 14 is attached to the upper end 13 of the probe 11. The loop 14 accommodates the distal end 15 of the ponytail 16 when creating the inverted ponytail hairstyle 17 as shown in FIG. 8.

Figure 2:
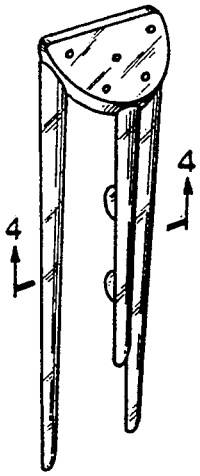
FIG. 2 is a left front perspective view of the hair pin made in accordance with the present invention.

FIG. 2 is an illustration of the preferred embodiment of the hair pin 20 of the present invention. The hair pin 20 preferably includes three prongs, specifically a left rear prong 21, a right rear prong 22 and a front prong 23. All three prongs include upper ends 24, 25 and 26 which are attached to the platform 27. The lower ends 28, 29 and 30 of the prongs 21, 23 and 22 extend downwardly into the hair as will be seen below. The inwardly protruding tabs 33 and 34 of the front prong 23 provide locking engagement of the hair binding element 35 or the stop means for engaging the hair binding element 35 (se FIG. 10). The platform 27 provides support for the decorative article 40 shown in FIG. 5.

Figure 3:
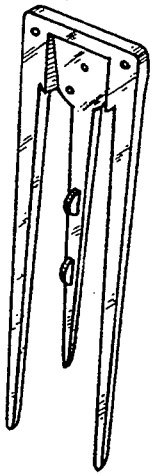
FIG. 3 is a left rear perspective view of the hair pin shown in FIG. 2.

FIG. 3 illustrates the upper tab 33 and lower tab 34 of the stop means of the front prong 23. When the hair pin 20 is secured in place, the hair binding element 35 is disposed in front of the rear prongs 21 and 22 and behind the front prong 23 and further between the upper tab 33 and the lower tab 34. The upper tab 33 and the lower tab 34 prevent undue vertical movement of the hair pin 20 after the user has properly affixed the hair pin 20 to the hairstyle shown in FIGS. 8 and 9. Alternatively, the hair binding element 35 may be engaged between the upper tab 33 and the platform 27 or between the lower tab 34 and a third bottom tab (not shown).

It will be noted that the tabs 33, 34, or the stop means, may alternatively be disposed on one or more rear prongs 21, 22 although the preferred embodiment includes the tabs 33, 34 disposed on the single front prong 23 shown in FIG. 3. Further, the hair pin 20 may include more than one front prong 23 and each front prong 23 may include tabs, such as 33, 34.

Figure 4:
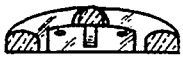
FIG. 4 is a sectional view taken substantially along lines 4—4 of FIG. 2.

FIG. 4 shows the relative displacement between the front prong 23 and the rear prongs 21 and 22. As noted above, the hair binding element 35 extends between the rear prongs 21, 22 and the front prong 23 and further below the upper tab 33 and above the lower tab 34 (not shown in FIG. 4).

Figure 5:
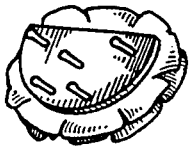
FIG. 5 is a rear perspective view of an ornamental article or decorative item to be affixed to the hair pin shown in FIG. 2.

FIG. 5 is an illustration of a flower-type decorative item 40 affixed to its own support platform 41 which is then attached to the platform 27 of the hair pin 20. The decorative item 40 may be attached to the platform 27 by sewing, gluing, snapping or other means of attachment. Further, the decorative item 40 may be detachably attached to the platform 27 so that the decorative items, such as 40, may be removed from platform 27 and replaced with alternative decorative items.

Figure 6:
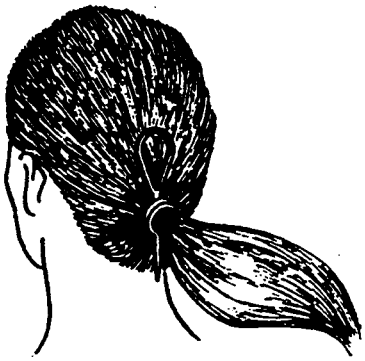
FIGS. 6, 7 and 8 illustrate the use of the hair styling tool shown in FIG. 1 to invert a hair tail, or a ponytail, to create an inverted ponytail hairstyle.
Figure 7:
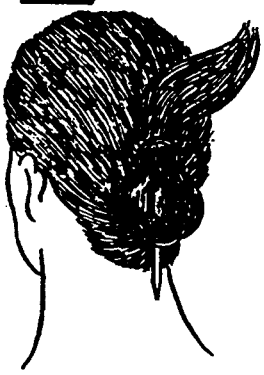

FIGS. 6 through 8 illustrate the method of creating the hairstyle first disclosed in U.S. Pat. No. 5,036,870, commonly referred to as a TOPSYTAIL hairstyle. First, the lower end 12 of the probe 11 of the hair styling tool 10 is inserted through the ponytail 16 between the hair binding element 35 (which may be an elastic or rubber band) and the user's head, shown generally at 36. The loop 14 is above the elastic band 35 so that the distal end 15 of the ponytail 16 may be inserted through the loop as shown in FIG. 7. After the position shown in FIG. 7 is achieved, the user grasps the lower end 12 of the probe 11 and pulls downward thereby pulling the ponytail 16 and the loop 14 of the hair styling tool 10 through the ponytail 16 to create the inverted ponytail 17 shown in FIG. 8.

The hairstyle 17 shown in FIG. 8 is durable and self-holding. Further, as shown in FIGS. 6 and 7, the hairstyle shown in FIG. 8 is fast and easy to prepare. No additional hair spray or styling gels are required to keep the hair in the same position as shown in FIG. 8.

Figure 9:
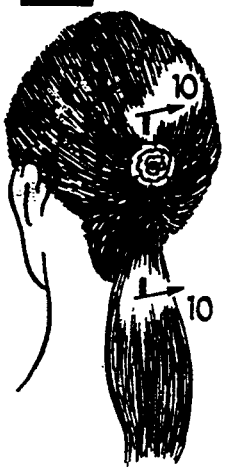
FIG. 9 is an illustration of the hair pin shown in FIG. 2, adorned with the ornamental article shown in FIG. 5, as attached to the hairstyle shown in FIG. 8.
Figure 10:
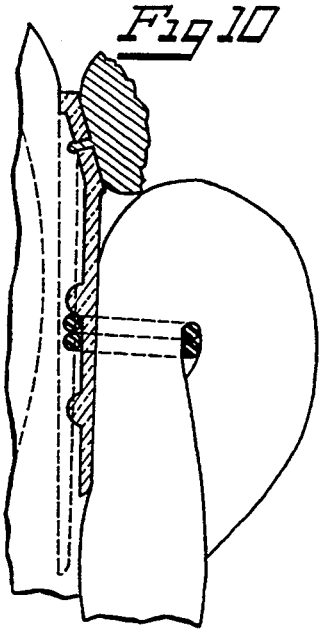
FIG. 10 is a sectional view taken substantially along lines 10—10 of FIG. 9.

The improvement to a TOPSYTAIL hairstyle shown in FIG. 8 contributed by the hair pin 20 first shown in FIG. 2 is illustrated in FIG. 9. Specifically, the hair pin 20 shown in FIG. 2 is adorned with the decorative item 40 shown in FIG. 5. The hair pin 20 is inserted downward through the hair far enough so that the elastic band 35 is engaged between the upper tab 33 and lower tab 34 of the front prong 23 as shown in FIG. 10. Further, the elastic band 35, or hair binding element, is securably accommodated in front of the rear prongs 21 (22 is not shown in FIG. 10) and behind the front prong 23 as well as between the upper tab 33 and the lower tab 34. The position of the hair pin 20 shown in FIG. 10 is secure and the tabs 33 and 34 prevent undue vertical movement of the hair pin 20 from the position shown in FIG. 10.

Thus, an improvement to the hair styling tool and hair styling method disclosed in U.S. Pat. No. 5,036,870 is provided by the present invention. A TOPSYTAIL hairstyle is still easily created and can now be easily adorned with a decorative hair pin that will not fall out. The decorative hair pin provided by the present invention stays in place and does not come out of the hairstyle during the day because of the unique means for locking the hair pin in place provided by the tabs of the front prong.

Although only one preferred embodiment of the present invention has been illustrated and described, it will at once be apparent to those skilled in the art that variations may be made within the spirit and scope of the invention. Accordingly, it is intended that the scope of the invention be limited solely by the scope of the hereafter appended claims and not be any specific wording in the foregoing description.

What is claimed is:

1. A hair pin for attachment to a hair binding element used to form a hair tail on a user's head, the hair pin comprising:

a platform having an upper surface being slanted upwardly and backwardly such that said platform occupies a spaced generally above the hair binding element when the hair pin is attached to the hair binding element on the head, at least two prongs including at least one front prong and at least one rear prong, said prongs extending downwardly from an underside of said platform, each at least one rear prong being disposed adjacent to the head of the user, each at least one front prong being disposed outward from each rear prong and outward from the head of the user, said front and rear prongs positioned to accommodate the hair binding element therebetween, and at least one of said at least one front prong and said at least one rear prong including a stop for engaging the hair binding element, whereby a relative vertical position of the hair pin is maintained when the hair binding element is accommodated between said front and rear prongs and is engaged by said stop.

2. The hair pin of claim 1, further comprising a decorative item attached to the upper surface of the platform.

3. The hair pin of claim 2, wherein said decorative item is detachably attached to said platform thereby enabling replacement of the decorative item with an alternative decorative item.

4. The hair pin of claim 1, wherein said stop for engaging the hair binding element is disposed on said at least one front prong and includes at least two inwardly protruding tabs disposed on said at least one front prong with a section therebetween, said two tabs include a top tab and a bottom tab for engaging the hair binding element therebetween.

5. The hair pin of claim 1, wherein said stop for engaging the hair binding element is disposed on said at least one front prong and includes at least one inwardly protruding tab disposed on said at least one front prong below said platform with a section therebetween, said tab and said platform operable to engage the hair binding element therebetween.

6. The hair pin of claim 1, wherein said stop for engaging the hair binding element is disposed on said at least one rear prong and includes at least two inwardly protruding tabs disposed on said at least one rear prong with a section therebetween, said tabs including a top tab and a bottom tab for engaging the hair binding element therebetween.

7. The hair pin of claim 1, wherein said stop for engaging the hair binding element is disposed on said at least one rear prong and includes at least one inwardly protruding tab disposed on said at least one rear prong below said platform with a section therebetween, said tab and said platform operable to engage the hair binding element therebetween.

8. The hair pin of claim 1, wherein said stop for engaging the hair binding element further comprises:

at least two inwardly protruding tabs disposed on said at least one front prong, said two tabs include a top tab and a bottom tab with a section therebetween, said top and bottom tabs for engaging the hair binding element therebetween; and at least two inwardly protruding tabs disposed on said at least one rear prong, said tabs including a top tab and a bottom tab with a section therebetween, said top and bottom tabs for engaging the hair binding element therebetween.

9. The hair pin of claim 1, wherein said stop for engaging the hair binding element further comprises:

at least one inwardly protruding tab disposed on said at least one front prong below said platform with a section there between, said tab and said platform operable to engage the hair binding element therebetween; and at least two inwardly protruding tabs disposed on said at least one rear prong, said tabs including a top tab and a bottom tab with a section therebetween, said top and bottom tabs for engaging the hair binding element therebetween.

10. The hair pin of claim 1, wherein said stop for engaging the hair binding element further comprises:

at least one inwardly protruding tab disposed on said at least one front prong below said platform with a section therebetween, said tab and said platform operable to engage the hair binding element therebetween; and at least one inwardly protruding tab disposed on said at least one rear prong below said platform with a section therebetween, said tab and said platform operable to engage the hair binding element therebetween.

11. The hair pin of claim 1, wherein said stop for engaging the hair binding element further comprises:

at least two inwardly protruding tabs disposed on said at least one front prong, said two tabs include a top tab and a bottom tab with a section therebetween, said top and bottom tabs for engaging the hair binding element therebetween; and at least one inwardly protruding tab disposed on said rear prong below said platform with a section therebetween, said tab and said platform operable to engage the hair binding element therebetween.

12. A hair pin for attachment to a hair binding element used to form a hair tail on a user's head, the hair pin comprising:

a platform having an upper surface being slanted upwardly and backwardly such that said platform occupies a space generally above the hair binding element when the hair pin is attached to the hair binding element on the head;

a right rear prong, a left rear prong, and a front prong, said rear prongs and said front prong extending downwardly from an underside of said platform, said rear prongs being disposed adjacent to the head of the user, said front prong being disposed outward from each rear prong and outward from the head of the user, said front prong and said rear prongs positioned to accommodate the hair binding element therebetween;

said rear prongs being generally parallel and defining a plane, said front prong being disposed offset and generally parallel to said plane, said rear prongs being of generally equal length and said front prong being shorter than said rear prongs; and at least one of said right rear prong, said left rear prong, and said front prong including a stop for engaging the hair binding element, whereby a relative vertical position of the hair pin is maintained when the hair binding element is accommodated between said front prong and said rear prongs and is engaged by said stop.

13. The hair pin of claim 12, wherein said rear prongs and said front prong are generally tapering from a thicker end adjacent said platform to a narrower tip opposite said thicker end.

14. The hair pin of claim 12, further comprising a decorative item attached to the upper surface of the platform.

15. The hair pin of claim 12, wherein said stop comprises at least one inwardly protruding tab disposed on at least one rear prong and below said platform with a section therebetween, said tab and said platform operable to engage the hair binding element therebetween.

16. The hair pin of claim 12, wherein said stop comprises at least two inwardly protruding tabs disposed on at least one rear prong, said tabs including a top tab and a bottom tab for engaging the hair binding element therebetween.

17. The hair pin of claim 12, wherein said stop comprises at least one inwardly protruding tab disposed on said front prong and below said platform with a section therebetween, said tab and said platform operable to engage the hair binding element therebetween.

18. The hair pin of claim 12, wherein said stop comprises at least two inwardly protruding tabs disposed on said front prong, said tabs including a top tab and a bottom tab for engaging the hair binding element therebetween.

19. The hair pin of claim 12, wherein said stop further comprises:

at least two inwardly protruding tabs disposed on said front prong, said tabs including a top tab and a bottom tab for engaging the hair binding element therebetween; and at least two inwardly protruding tabs disposed on at least one rear prong, said tabs including a top tab and a bottom tab for engaging the hair binding element therebetween.

20. A method of inverting a hair tail of a user's head and affixing a decorative hair pin thereto, the hair tail including a distal end, the hair tail being bound by a hair binding element disposed between the head of the user and the distal end of the hair tail, the method comprising the steps of:

inserting a lower end of an elongated probe in the hair tail between the head and the hair binding element, the elongated probe including an upper end and a loop attached thereto, inserting the end of the hair tail through the loop, pulling the probe, the loop and the distal end of the hair tail through a portion of the hair tail between the head and the hair binding element to invert the hair tail to form an inverted hair tail, attaching the hair pin to a portion of the hair binding element between the inverted hair tail and the head of the user, the hair pin including at least one rear prong and at least one front prong, the front and rear prongs extending downwardly from an underside of a platform, the rear prong being disposed between the head and a portion of the hair binding element disposed between the inverted hair tail and the head, the front prong being disposed between the inverted hair tail and the head, at least one prong including a stop for engaging the hair element, whereby a relative vertical position of the hair pin is maintained when the hair binding element is accommodated between the front and rear prongs and the hair binding element is engaged by the stop.

* * * * *

UNITED STATES PATENT AND TRADEMARK OFFICE

CERTIFICATE OF CORRECTION

PATENT NO. : 5,345,956

DATED : September 13, 1994

INVENTOR(S) : Edmark

It is certified that error appears in the above-identified patent and that said Letters Patent is hereby corrected as shown below:

Column 2, line 30, delete "biding" and insert -- binding --.

Column 8, line 62, after "hair", insert -- binding --.

Signed and Sealed this

Ninth Day of May, 1995

Bruce Lehman

*Attest:*

BRUCE LEHMAN

*Attesting Officer*

*Commissioner of Patents and Trademarks*